US005593236A

United States Patent [19]

Bobry

[11] Patent Number: 5,593,236

[45] Date of Patent: Jan. 14, 1997

[54] HAND-HELD SWEEP ELECTRONIC PRINTER WITH COMPENSATION FOR NON-LINEAR MOVEMENT

[76] Inventor: Howard H. Bobry, 18416 Olympic View Dr., Edmonds, Wash. 98020

[21] Appl. No.: 554,043

[22] Filed: Nov. 6, 1995

[51] Int. Cl.[6] ..... B41J 3/39

[52] U.S. Cl. ..... 400/88

[58] Field of Search ..... 400/88, 120 HH

[56] References Cited

U.S. PATENT DOCUMENTS

| | | | |
|---|---|---|---|
| 3,656,169 | 4/1972 | Kashio | 346/1 |
| 3,767,020 | 10/1973 | Rowe | 197/1 R |
| 4,168,533 | 9/1979 | Schwartz | 364/900 |
| 4,211,012 | 7/1980 | Alles et al. | 33/18 R |
| 4,377,741 | 3/1983 | Brekka et al. | 235/472 |
| 4,436,439 | 3/1984 | Koto | 400/126 |
| 4,450,454 | 5/1984 | Koto | 346/140 R |
| 4,611,246 | 9/1986 | Nihei | 358/256 |
| 4,663,639 | 5/1987 | Owen et al. | 346/140 R |
| 4,673,303 | 6/1987 | Sansone et al. | 400/126 |
| 4,740,799 | 4/1988 | Mason et al. | 346/140 A |
| 4,748,460 | 5/1988 | Piatt et al. | 346/140 R |
| 4,758,849 | 7/1988 | Piatt et al. | 346/140 R |
| 4,819,083 | 4/1989 | Kawai et al. | 358/294 |
| 4,883,491 | 11/1989 | Mallory et al. | 623/22 |
| 4,899,228 | 2/1990 | Sano et al. | 400/88 |
| 4,901,164 | 2/1990 | Kurosawa | 358/473 |
| 4,928,183 | 5/1990 | Yajima | 358/296 |
| 4,949,283 | 8/1990 | Yamauchi et al. | 364/519 |
| 5,012,349 | 4/1991 | de Fay | 358/296 |
| 5,013,895 | 5/1991 | Iggulden et al. | 235/110 |
| 5,063,451 | 11/1991 | Yanagisawa et al. | 346/143 |
| 5,083,814 | 1/1992 | Guinta et al. | 283/70 |
| 5,093,675 | 3/1992 | Koumura et al. | 346/143 |
| 5,099,256 | 3/1992 | Anderson | 346/1.1 |
| 5,240,334 | 8/1993 | Epstein et al. | 400/88 |
| 5,311,208 | 5/1994 | Burger et al. | 345/163 |
| 5,325,118 | 6/1994 | Zybin et al. | 347/47 |
| 5,343,227 | 8/1994 | Hirosawa et al. | 349/42 |

*Primary Examiner*—Stephen R. Funk
*Assistant Examiner*—Steven S. Kelley
*Attorney, Agent, or Firm*—Rankin, Hill, Lewis & Clark

[57] ABSTRACT

A hand-held and self contained electronic printing apparatus for printing indicia on a medium disposed outside the apparatus includes a housing that can be manually positioned adjacent a surface of the medium and manually swept across a printing area on the medium during a printing sequence; a printer disposed in the housing and having a print head with a plurality of print elements such as ink jet nozzles for printing indicia in a selectable pattern of dots on the medium within the printing area; and an electronic control circuit disposed in the housing for controlling the printer to print indicia on the medium during a printing sequence, the control circuit comprising compensation for reducing image distortion based on detecting position of the nozzles during a printing sequence.

43 Claims, 11 Drawing Sheets

HAND-HELD SWEEP ELECTRONIC PRINTER WITH COMPENSATION FOR NON-LINEAR MOVEMENT

BACKGROUND OF THE INVENTION

The invention relates generally to methods and apparatus for printing and recording indicia and information on a medium such as paper, for example. More particularly, the invention relates to fully self contained and hand-held printing apparatus that is operated, for example, using a sweeping motion of the apparatus across a selectable area of the medium.

Hand-held printers known heretofore that are operated with a sweeping motion across the medium, have used external input functions, such as from a remote computer, for example, have been limited in the quantity, single line output, type and variety of information that can be printed, and can exhibit considerable image distortion. This distortion arises from movement of the print head along a non-linear path. Additionally, in a hand controlled sweeping device, it is possible to rotate the print head such as by a pivoting action brought about by the natural tendency of an operator to allow the apparatus to tilt or rotate during a sweeping action. This pivoting action changes the orientation of the print head with respect to the medium and thus can further result in distortion of the printed image. In some cases, mechanical devices have been incorporated into the printer to restrict or constrain movement to a linear path and to reduce the occurrence of a pivoting or rotational motion imparted to the apparatus. Such devices are less than desirable as the mechanical constraints reduce the flexibility of the apparatus, increase the apparatus size and weight, and do not achieve a convenient replacement for a conventional mechanical stamping device.

The objectives exist, therefore, for providing a more convenient apparatus and methods for a hand-held and operated fully self contained printer that is responsive to a simple and unconstrained sweeping motion and that exhibits reduced distortion in the printed indicia caused by such sweeping motion.

SUMMARY OF THE INVENTION

To the accomplishment of the foregoing objectives, the present invention contemplates, in one embodiment, a hand-held and self contained electronic printing apparatus for printing indicia on a medium disposed outside the apparatus comprising a housing that can be manually positioned adjacent a surface of the medium and manually swept across a printing area on the medium during a printing sequence; a printer disposed in the housing and having a print head with a plurality of print elements for printing indicia in a selectable pattern of dots on the medium within the printing area; and electronic control means disposed in the housing for controlling the printer to print indicia on the medium during a printing sequence, the control means comprising compensation means for reducing image distortion based on detecting position of the print elements during a printing sequence.

These and other aspects and advantages of the present invention will be readily understood and appreciated by those skilled in the art from the following detailed description of the preferred embodiments with the best mode contemplated for practicing the invention in view of the accompanying drawings.

DETAILED DESCRIPTION OF THE INVENTION

Figure 1:
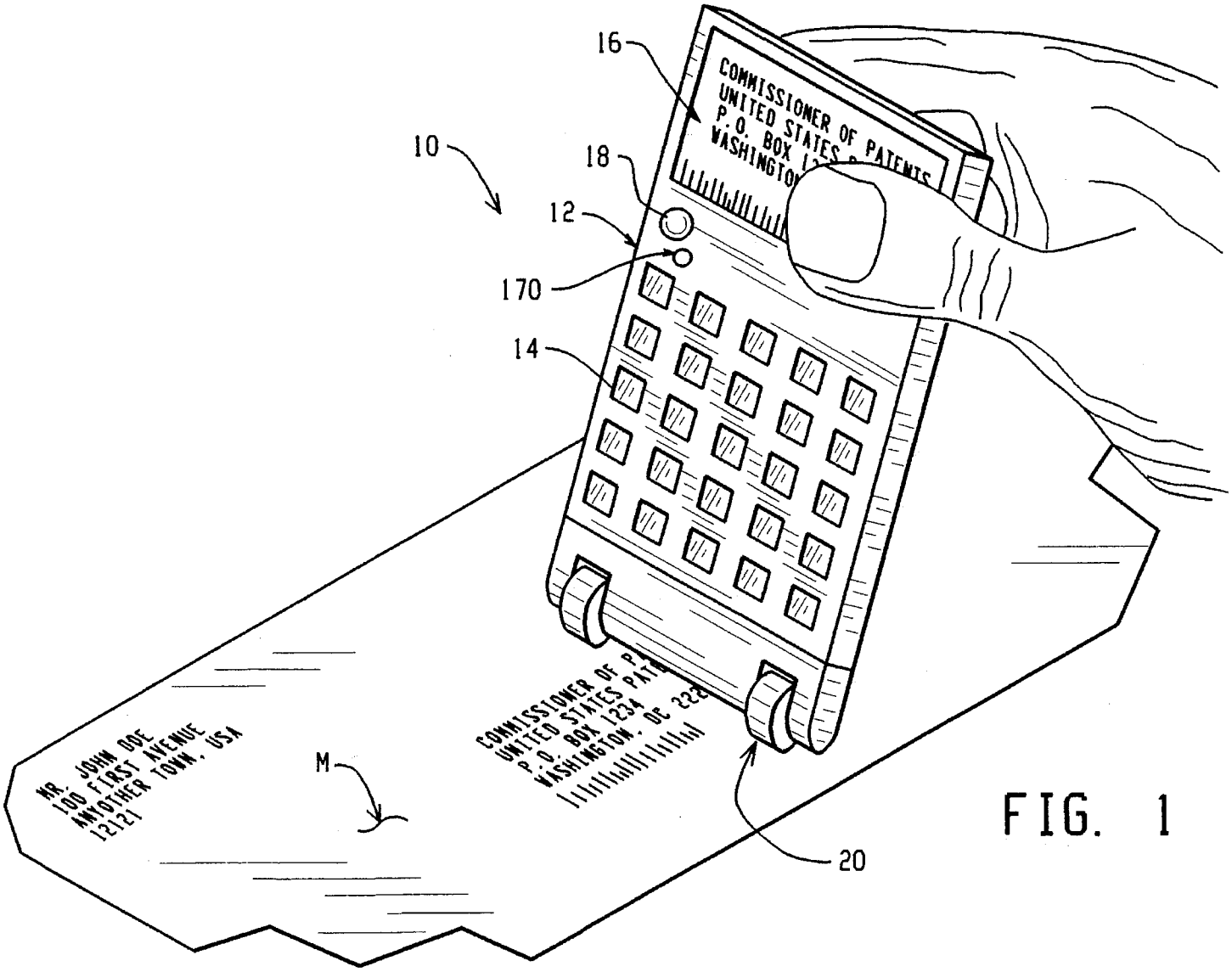
FIG. 1 is a simplified schematic perspective of a self contained and hand operated printing apparatus according to the present invention.

With reference to FIG. 1, an embodiment of the invention is illustrated in simplified schematic form for purposes of describing the basic concepts of the invention. In this exemplary configuration, a hand-held and operated printing apparatus 10 is illustrated. A significant feature of this apparatus is that it is a completely self contained unit that can be manually operated without an external connection. However, as will be explained hereinafter, the apparatus 10 is equipped with interface devices, which can be hardwired connectors or wireless links, to permit external data entry and/or control if so desired for a particular application.

In the embodiment of FIG. 1, the apparatus 10 is shown disposed adjacent a medium, M, in this case a paper envelope. Although the invention is illustrated and described herein with specific reference to printing on a flat web of paper, such as an envelope, sheet paper, and so on, such description is exemplary for purposes of illustration and explanation and should not be construed in a limiting sense. Those skilled in the art will readily appreciate that the invention can be utilized for printing indicia, images, characters, bar codes, text and so on in virtually any color, as well as black or white, on any medium that is compatible with the selected printer mechanism used in the apparatus 10. The printer mechanism can be selected from any number of commercially available units, or special made, depending on the particular application. In the embodiments described herein, the printer mechanism is an ink jet type printer, sometimes referred to as a bubble jet printer, such printer being generally of the type that emits, projects or ejects ink through a number of nozzles, in response to electrical control signals, so that each individual ink projection produces a dot on the print medium. In many applications of the invention, other print mechanisms both known and later developed will also be suitable for use with the present invention. Furthermore, in all the embodiments described herein, reference is made to "nozzles" as providing the source of ink and thus causing a "dot" to appear on the medium. Those skilled in the art will appreciate that other printing techniques can be used with the invention, including thermal print heads, impact printing and so on. Thus, the term "print elements" is used herein to generally refer to the print head element that produces the dot or indicia on the medium, with the described embodiments herein using ink jet/bubble jet nozzles as the print elements.

The apparatus 10 includes a housing 12 which for convenience may be made from metal, plastic, composites or other suitable material. The housing 12 preferably is a rigid structure that is capable of supporting a printing mechanism therein along with an electronics package and an internal power supply, such as a battery. The housing 12 should also be sturdy enough to withstand manual forces applied to the structure to actuate the apparatus without damage or stress. The housing 12 should also provide a stable platform so that the apparatus 10 can be manually held and stably positioned adjacent the medium M, as illustrated in FIG. 1, for example, and easily swept across a portion of a surface of the medium.

The housing 12 holds a key pad device 14, which for convenience can be a conventional push pad or thin membrane type key pad. The housing 12 also holds a display device 16 such as a conventional LCD or LED display. Internal to the housing 12 (not shown in FIG. 1) is a circuit board or boards which hold the various electronic components and power supply components for operating the electronic printing apparatus 10.

Part of the control circuitry may include an interface device, such as, for example, a conventional transceiver 18, that transmits and receives data and/or instructions from a remote device (not shown) such as a personal computer, for example. A suitable transceiver device 18 is an infrared transceiver, although other communication links could be used such as RF, microwave, acoustic and so on.

In the embodiment of FIG. 1, the apparatus 10 is supported on the medium during a printing sequence by one or more rollers 20. These rollers are coupled to encoder devices and will be explained in greater detail hereinafter. The rollers 20 in combination with the encoders provide an enabling function for the apparatus 10 in which movement of the apparatus across the medium is sensed and a signal can be generated to initiate the printing of indicia on the medium. If so desired, a push button enable switch (see discussion of switch 54 shown in FIG. 2) or other mechanical release can be included for manual actuation prior to a printing sequence being permitted to occur.

Figure 3:
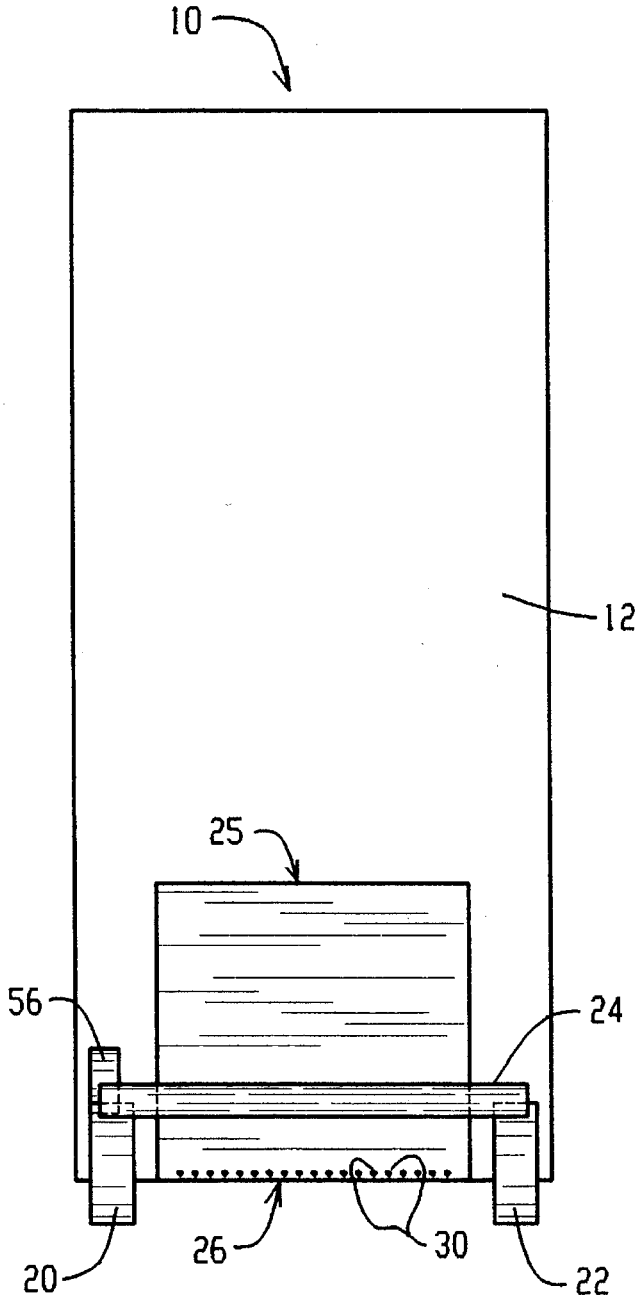
FIG. 3 is a simplified schematic in elevation of a printing apparatus according to the invention using a full width ink jet print head embodiment.

As best illustrated in FIG. 3, a bottom end of the housing 12 includes an aperture through which printing is accomplished by a printer mechanism 25 while the apparatus 10 is positioned adjacent the medium. In this example, the printing mechanism includes a print head 26 that preferably extends to a flush position at the bottom end of the housing 12. Although not shown in the drawings, a reflective photosensor can be mounted in the housing near the print head to provide an additional control signal to indicate that the apparatus 10 is correctly positioned adjacent a medium, although this added redundancy will not be needed in many applications. Furthermore, a removable print head cover can be provided (not shown) that protects the print head 26 when not in use.

Note in FIG. 3 that the printer mechanism 25 includes a print head 26 which is supported in the housing 12. The print head 26 in this example consists of a single row of ink jet nozzles 30 which are represented schematically in FIG. 3 by a row of dots. If desired for a particular application, additional rows of nozzles can be used, particularly for color printing. Additional print heads can also be used. The width of the print head 26 generally defines the height of the printing area on the medium. The nozzles 30 project ink in generally parallel trajectories with respect to each other towards the medium. However, the nozzles 30 can also be disposed in the print head 26 so as to project ink at diverging angles with respect to each other if so desired.

Figure 2:
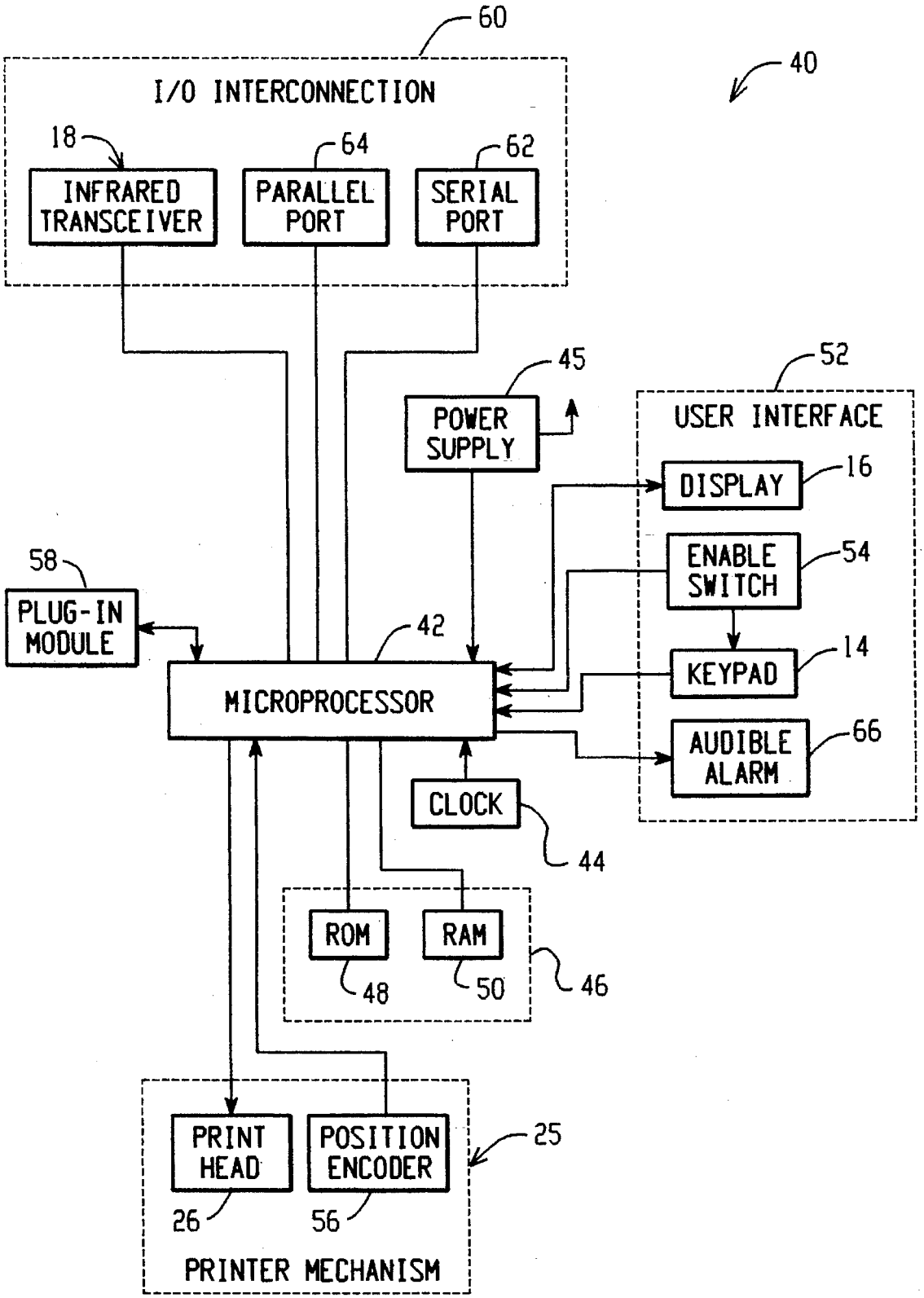
FIG. 2 is an electrical schematic diagram of a control circuit suitable for use with the printer apparatus of FIG. 1.

With reference next to FIG. 2, there is shown in simplified block diagram form a control circuit 40 suitable for use with all the embodiments of the present invention described herein. Those skilled in the art will readily appreciate that many of the features of this control circuit 40 are optional and can be used or omitted as desired for a particular application. Furthermore, although the circuit 40 is described in terms of a microprocessor based system, the invention can conveniently be practiced with the use of a microcontroller, microcomputer, digital signal processing, application specific integrated circuit (ASIC) and discrete logic circuits depending on the overall complexity of the control functions for a particular application.

In FIG. 2, a microprocessor 42 is connected to a number of peripheral circuits, and is used to provide the overall control function for the apparatus 10. A significant feature of the invention is that the apparatus 10 is a wholly self contained and operational hand-held printer that does not require the use of external inputs and controls. Thus, all of the circuits in FIG. 2 are fully contained within the housing 12. However, provision is made for external connection should such a configuration be desired for a specific application. The microprocessor 42 is programmed in a conventional manner according to the manufacturer's instructions, as is well known to those skilled in the art. A suitable microprocessor is part no. MC6800 available from Motorola Incorporated. For embodiments that utilize additional control and processing functions, it may be desirable to use a more powerful microprocessor such as part no. NS486SXF available from National Semiconductor, Inc.

A system clock 44 provides timing pulses at regular intervals for the operation of the system, including tracking current time and date information. A replaceable or rechargeable battery type power supply 45 provides system power for the microprocessor 42 and all other circuits within the housing 12.

The microprocessor 42 accesses program instructions and data via a memory circuit 46 which includes a non-volatile ROM memory 48 and a suitable volatile temporary memory, such as a RAM memory 50. The ROM is used to store control programs, conversion tables and the like for the microprocessor 42, as well as fixed information such as commonly printed phrases such as "RECEIVED" or "FAXED", or graphics images including bar code images and other indicia. The RAM 50 is used to store system data produced during operation such as an activity log, where the log may include, for example, information that was printed, identification of the source, date and time of the printing. The RAM 50 can also be used to accumulate a running total of the number of dots printed, with the total being reset to zero each time the ink supply associated with the print head 26 is replenished or replaced. By comparing the total number of dots that can be printed using the ink supply, with the actual number of dots printed since the supply was last filled, the microprocessor 42 can generate a warning that the ink supply is low, for example, at about 5% capacity. The RAM can further be used to store programs, instructions and data entered manually by the operator through a user interface 52, or received from an external source such as a computer through an input/output (I/O) device 60, or the results of calculations performed by the microprocessor 42. These calculations may include coordinate conversions, distortion compensation, data used to generate bar codes, and so on. Those skilled in the art will readily appreciate that the volatile memory 50 can also be realized in the form of a FIFO memory, for example. The particular hardware selected for use in realizing the various components of the control circuit 40 will depend on the specific system requirements needed or desired.

A user interface circuit 52 includes the visual display 16 and the key pad 14. The display 16 is used to view the print image prior to printing, as illustrated in an exemplary manner in FIG. 1. The display 16 can also be used to communicate warnings (such as low ink supply or low battery), status information or a prompt to request data entry. The key pad 14 is used, for example, for selecting items to be printed from a menu displayed by the apparatus 10, or for creating indicia to be printed, as well as for data entry and command inputs.

A manually actuated enable switch 54 is provided, preferably on the housing 12, that the operator operates and holds during a printing sequence. This prevents accidental operation of the printing apparatus 10. Note in FIG. 2 that the enable switch 54 also provides a disable function for the keypad 14 (represented by the line between the switch 54 and the keypad 14) during a printing operation. This prevents accidental actuation of the keypad 14 while the printer is operating. Actual disable control of the keypad 14 can be effected via the microprocessor 42 in response to actuation of the disable switch 54 by simply having the microprocessor 42 programmed to ignore all keypad 14 commands during a printing sequence.

A plug-in module 58 is provided so that information, instructions, or programs may be transferred between the apparatus 10 and an external source such as, for example, a computer. The module can be, for example, an industry standard PCMCIA card.

A communication link to an external apparatus is accomplished by use of an I/O device 60 such as a serial port 62, a parallel port 64 or a wireless link such as an RF transceiver, or the infrared transceiver 18, an acoustic transducer or a modem. The transceiver 18 may be, for example, a Hewlett-Packard HSDL-1000 transceiver.

The apparatus 10 further includes the printing mechanism 25, which in the exemplary embodiment includes an ink jet print head 26 and a print head position encoder 56. The encoder 56 can be, for example, Hewlett-Packard device HEDR-8000. Those skilled in the art will readily appreciate and understand that because the nozzles 30 are fixed in the print head 26, position data of the print head 26 can be easily converted into position data for each and every nozzle 30 on a real time basis.

In addition to providing position and movement information for the print head 26, the encoder 56 is also used to indicate to the microprocessor that a printing sequence is to begin. As the operator begins to sweep the apparatus 10 across the print surface of the medium, the encoder 56 begins to produce output pulses, so that these pulses can serve as an indication to begin printing. As used herein, the terms "printing sequence" and "printing operation" are used interchangeably to simply refer to the steps carried out between actuation of the apparatus 10 and completion of a printing function on the medium.

The position encoder 56 provides pulses to the microprocessor 42 as the print head 26 sweeps across the printing area. These pulses can be counted and timed and thus provide both position and velocity information about the print head 26, and in particular the nozzles 30 disposed on the head 26. The microprocessor 42 software utilizes the nozzle 30 position and velocity information to determine when to activate each nozzle based on the desired indicia to be printed on the medium for the current printing sequence.

The encoder 56 is operably coupled to the rollers 20 that support the apparatus 10 against the medium during a printing sequence. It is important to note that the encoder 56 will produce pulses caused by relative rotation between the print head 26 and the rollers 20. Therefore, position pulses are produced when the apparatus 10 is swept along the medium, and also produced by pivoting motion of the apparatus 10, even if at the time of pivoting the apparatus 10 is sweeping slowly or even stationary. The encoder 56 will also detect an accidental backward movement of the apparatus 10. Thus, the encoder output signals can be used for not only controlling printing during a sweeping operation, but also to compensate for print head deviations or changes caused by pivoting and other non-linear movements. The encoder 56 can be configured, for example, to produce a pulse for each incremental change in angular displacement of the rollers 20 relative to the print head 26. By the convenient use of look-up tables, calculations or approximations, the angular displacement of the rollers 20 can easily be converted to actual position data for each nozzle. The encoder 56 produces position pulses from the moment that rotation of the rollers 20 occurs relative to the print head 26.

An audible alarm 66 can conveniently be provided as part of the user interface 52. The audible alarm can serve a number of useful purposes, including an audible tone signal such as a short beep to indicate that a printing sequence is completed or a distinguishable audible tone signal that the sequence was not completed, such as, for example, by the operator lifting the apparatus 10 up from the medium before the printing is completed. The audible alarm 66 can be realized conveniently in the form of an amplifier and speaker controlled by suitable signals from the microprocessor 42 to produce different tones or combination of tones to indicate different conditions.

FIG. 3 is a simplified schematic in elevation of a printer mechanism 25 equipped with a full line type ink jet print head 26. This print head 26 is equipped with a plurality of ink jet nozzles 30 disposed to print a full line of length approximately equal to the width of the print image. If, for example, the printer 25 is designed to print a 2" wide image with a resolution of 100 dots per inch (dpi), then the print head 26 will comprise 200 nozzles at a pitch of 0.01".

The printer 25 is supported in use by a pair of rollers 20, 22, which are joined by a shaft 24, such that both rollers 20, 22 in this embodiment rotate together. Rollers 20, 22 have outer diameters composed of a material having a high coefficient of friction with paper or other material used for the medium, M, such as soft rubber or plastic. Movement of the printer apparatus 10 in a straight line over the print medium, on a path perpendicular to the axes of rollers 20, 22, uses significantly less force than movement over other paths, because only rolling motion of the rollers is required. Because of this, the motion of the printer 25 over the medium will inherently tend to track in a straight line path as desired.

An encoder 56 is driven by either of the rollers 20, 22 or the shaft 24. The encoder 56 may be, for example, an optical encoder such as Hewlett-Packard model HEDR-8000, which provides two output channels in quadrature relationship such that both direction and magnitude of rotation are measured. Speed or velocity of rotation and movement can be determined from timing the output pulses of the encoder 56.

Figure 4:
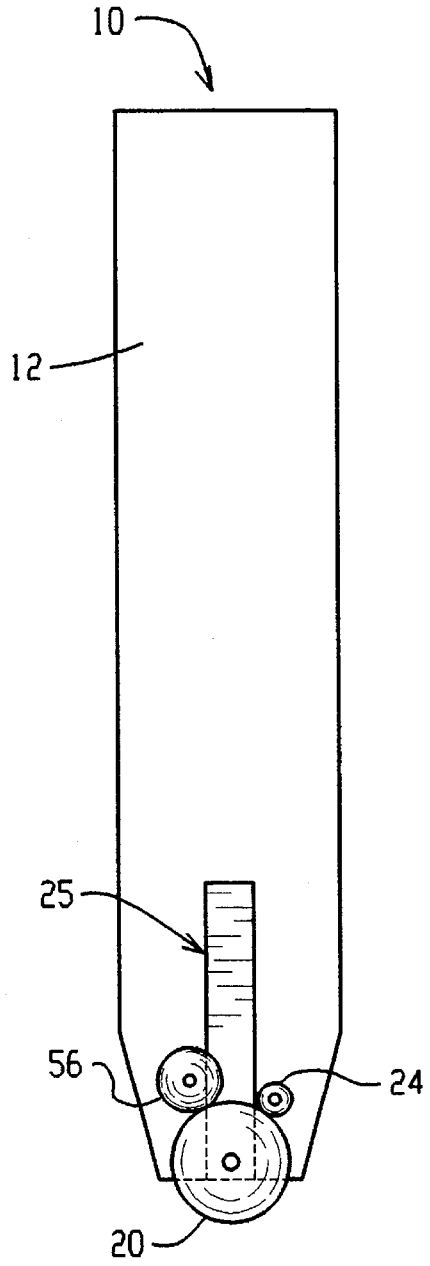
FIG. 4 is a side elevation of the embodiment illustrated in FIG. 3.
Figure 5A:
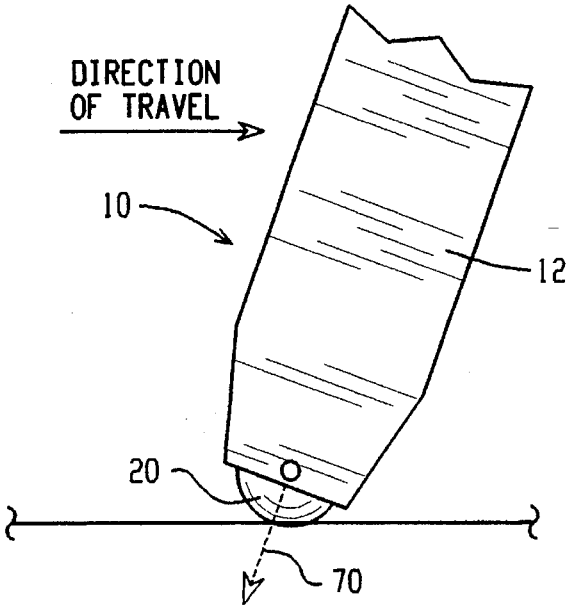
FIGS. 5A and 5B illustrate pivoting motion of the apparatus of FIG. 3.
Figure 5B:
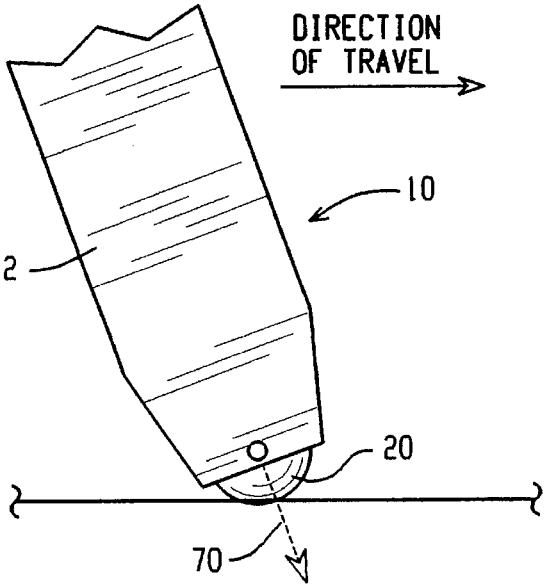

FIG. 4 is a schematic end view of the printer apparatus 10. Note than in operation, as the printer 25 is manually moved or swept across a print area on the medium, the rollers 20,22 and the shaft 24 rotate. The encoder 56 produces pulses corresponding with the motion of the print head 26 across the medium. In addition, however, the apparatus 10 is free to pivot about the rotational axis of the rollers 20,22. FIGS. 5A and 5B illustrate the effect of such pivoting motion, which, if uncorrected, could either compress or expand the print image, depending upon the direction of the pivoting motion. Pivoting the printer body 12 forward as in FIG. 5A aims the ink jet nozzles 30 backwards as represented by the directional line 70 and decrements the encoder 56 count, simulating backward motion of the print head 26; while pivoting the printer body backward as in FIG. 5B aims the ink jet nozzles 30 ahead and advances the encoder count thus appearing to be forward motion of the printer. The encoder 56 count is stored in memory either in the microprocessor 42, the RAM 50 or other memory device, and updated only when a new count exceeds the previous count, and in this manner the encoder count corresponding to the farthest advance of the printing is stored. Further printing is enabled only when the encoder count exceeds the previous high count stored in memory. This assures that if the printer is moved backwards, or pivoted forward, previously printed information will not be overprinted. Printing will resume when the printing mechanism 25 is moved forward, or pivoted backward, sufficiently to position newly printed information properly beyond previously printed information.

An alternative technique to prevent overprinting, in the event the printer 10 is either moved backwards or pivoted forward during a printing sequence, can be implemented by clearing or deleting the print image data from memory as it is printed. Once a dot location is printed, the data corresponding to that dot location is cleared from the memory, so that even if the print head 26 passes over the same location again, there will be no further printing at that position. It will be appreciated that it generally is desirable to retain a print image in memory, such as when an image will be printed more than once. This can readily be accommodated by retaining a separate copy of the print image in another memory sector, while the actual working copy for the present printing sequence is stored in a temporary memory, such as a scratch pad type memory.

Figure 6:
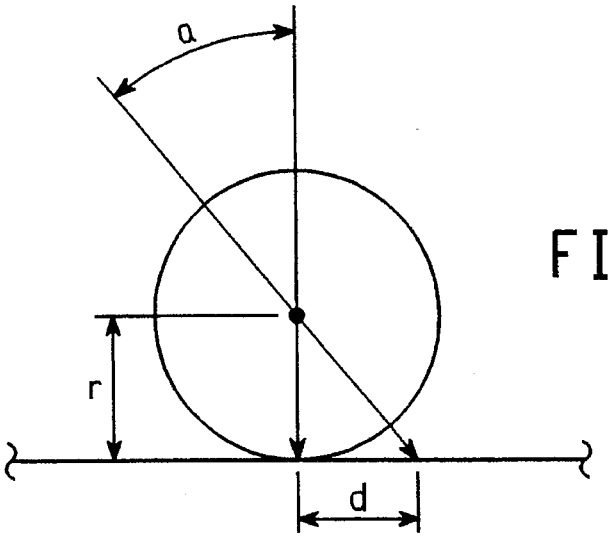
FIG. 6 is a graphical representation of geometric relationships for the print nozzles under pivoting motion as in FIGS. 5A and 5B.

It will be appreciated that the change in encoder count resulting from pivoting the apparatus body 12 about the roller 20, 22 axis of rotation does not correspond identically to the change in encoder count produced by a translation of the print head 26 over the print medium, and this will result in an insignificant residual error. This can best be illustrated by way of example. Assume, for example, that the printer rollers have a radius "r," and that the printer is pivoted backward from the perpendicular by an angle "a," resulting in an advance of the print image by a distance "d," as shown in FIG. 6. The magnitude of "d" may be calculated as follows:

$$d=r*\tan a$$

The encoder count will advance by an amount corresponding to a translation "t" of the printer by a distance equal to that portion of the roller circumference subtended by angle "a." If "a" is in degrees, then:

$$t=(a/360)*2\pi*r$$

For there to be no error introduced by pivoting the printer body, then "d" must equal "t," but this is true only at a=0. As the angle "a" increases, so too does the error in print position. Continuing with the example, and assuming r=0.25", pivoting the printer 45° from the perpendicular would introduce an error of 0.054".

At a dot pitch of 0.01" or less, this would appear to be a significant position error, and it indeed would be if the operator were to hold the printer stationary on the medium and pivot the printer body 45°. In actual usage, however, the printer body 12 would be pivoted only as the printer is translated over the print medium to effect printing of the desired image. If the example of a 45° pivot takes place over a translation distance of just 1", then the error of 0.054" is spread over that distance, and results in an insignificant 5.4% compression or expansion of the image.

By way of example and explanation, an image or indicia to be printed can be characterized as a matrix of dots laid out in a rectangular grid (recognizing that a printed pattern need not be rectangular at all) having an X axis and a Y axis, with each dot being described by a unique set of X,Y coordinates. The X axis is considered the intended direction of printer travel, and is perpendicular to the Y axis, which is identically the axis of the rollers 20, 22 at the start of a printing operation. The encoder 56 count increments as the printer is either advanced along the X axis or tilted backward (relative to the desired direction of travel). Thus, the X value for the last dot to be printed for the selected indicia can be used to define the end of the printing sequence. The X value for each dot is a relative position value along the direction of travel starting from the zero encoder count position when the printing sequence begins.

Figure 7:
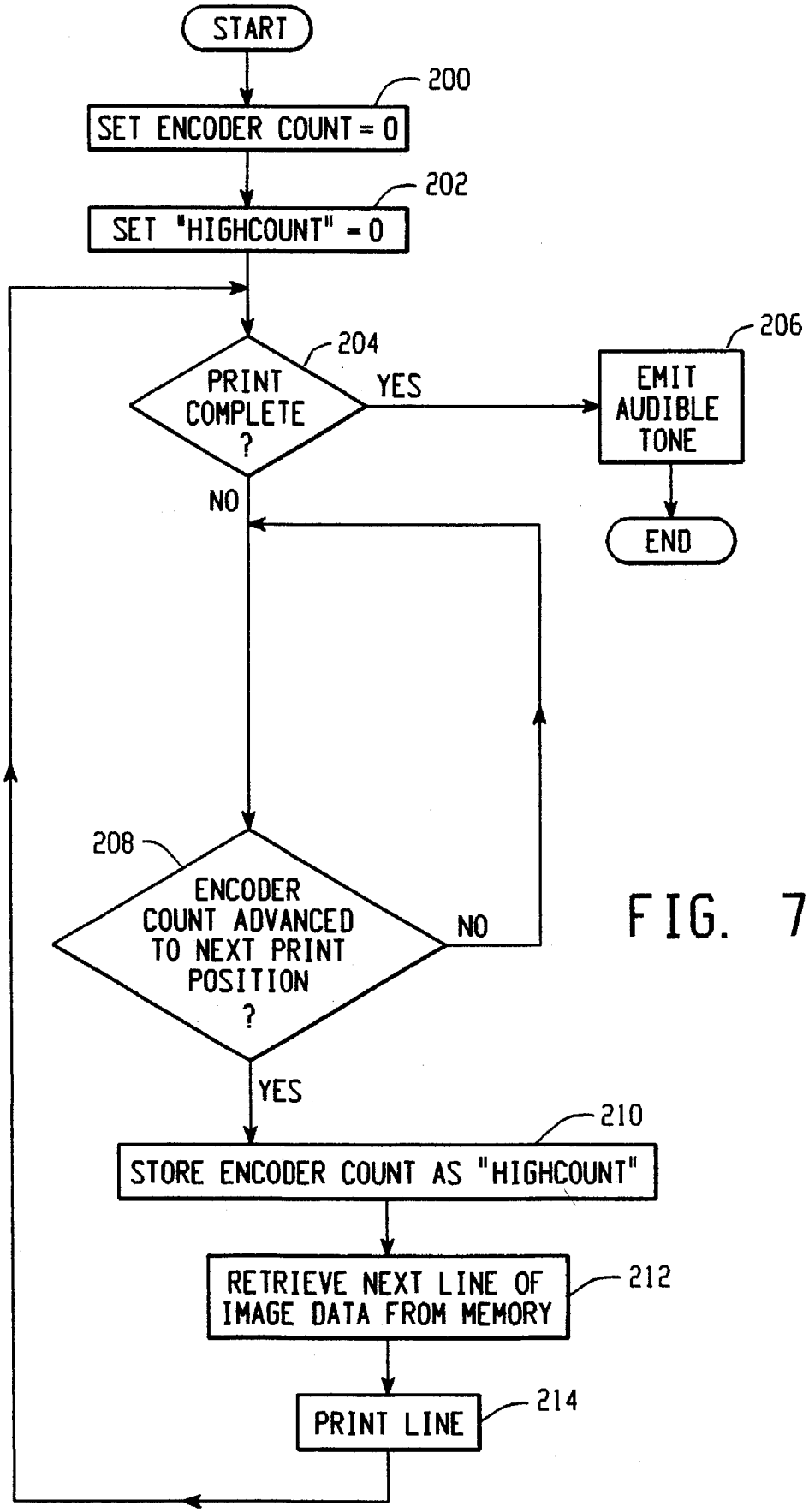
FIG. 7 is a flow chart for a control sequence of a printing operation in accordance with the invention as embodied in FIGS. 3–5.

FIG. 7 is a flow diagram for a control program suitable for use with the embodiment of FIGS. 3–5. At step 200 the encoder 56 count is zeroed; at step 202 the memory register for the HIGHCOUNT value is zeroed. At step 204, the program compares the X value corresponding to the present encoder count with the maximum X value at which a dot is to be printed. This maximum X value may be determined, for example, by examining the X value of each data point as it is loaded into the memory circuit 46 and updating a stored maximum X value whenever a higher X value is entered. In this manner, a distinct maximum X value is determined and stored for each separate image stored in the memory 46 either via the user interface 52, the I/O circuit 60, the module 58 or preloaded. Alternatively, for example, if the printing apparatus 10 is designed to print a print area having a predetermined and fixed length, then the maximum X value can be predetermined and fixed and stored in the non-volatile memory 48. When the present X value, as determined based on the encoder output count, exceeds the maximum X value, the printing sequence is complete and the program causes an audible tone at 206 and then ends.

If the printing sequence is not complete, the system checks at 208 whether the encoder 56 count has incremented such that the present count exceeds HIGHCOUNT by at least an amount corresponding to the pitch between successive lines of dots, indicating advancing movement of the print head across the printing area sufficient for further printing to take place. If yes, then the present count is used to update the HIGHCOUNT value at step 210 and the next line of image data is retrieved at step 212 and printed at step 214. If the result at step 208 is negative, the program loops back and waits for a positive result, indicating sufficient movement of the print head 26 to resume the printing operation.

Figure 8:
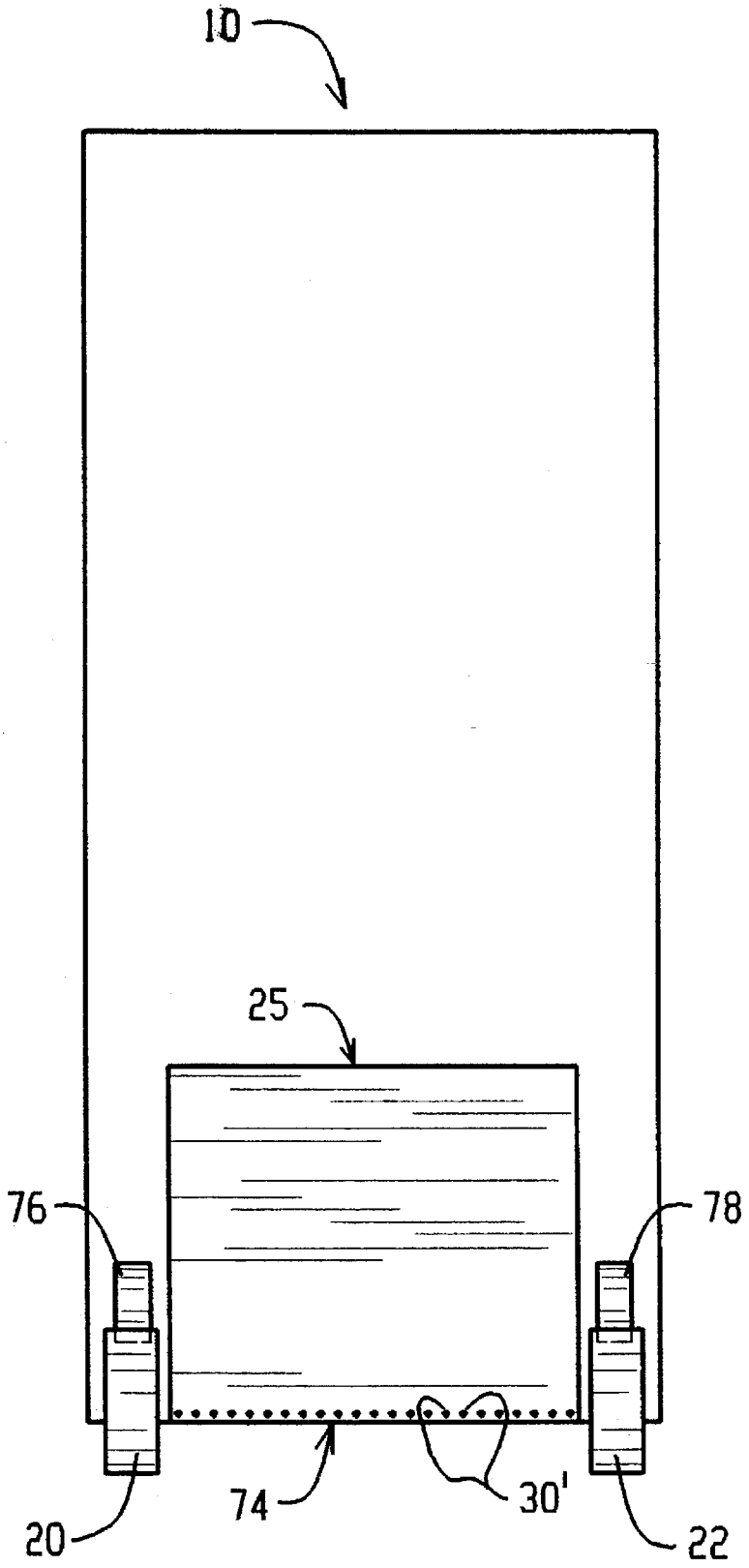
FIG. 8 is an elevation of another embodiment of the invention.

With reference to FIG. 8, another embodiment of the invention is illustrated. In this embodiment, the printer 25 is equipped with a full line type ink jet print head 74. This print head 74 is equipped with a plurality of ink jet nozzles 30' disposed to print a full line of length greater than the width of the print image. If, for example, the printer is designed to print a 2" wide image with a resolution of 100 dots per inch (dpi), then the print head 74 might comprise 250 nozzles at a pitch of 0.01", and be capable of printing a 2.5" wide swath.

The printer 25 is supported in use by the rollers 20, 22 in a manner similar to the embodiment of FIG. 3. However, in contrast to the embodiment of FIG. 3, these rollers are disposed for rotation independently of each other. The rollers 20, 22 can be mounted on a single shaft or separate shafts, but the intent is to achieve completely independent rotation of the rollers with respect to each other.

Each roller 20, 22 drives a respective encoder 76, 78. Each encoder can be of any suitable design, such as Hewlett-Packard model HEDR-8000, with each encoder providing two output channels in quadrature relationship such that both direction and magnitude of rotation of each of the two rollers is independently measured.

The rotationally independent rollers 20, 22 and associated encoders 76, 78, as well as the extra width of the print head 74, enable electronic compensation for translation of the printer along a path other than a straight linear path.

Figure 9:
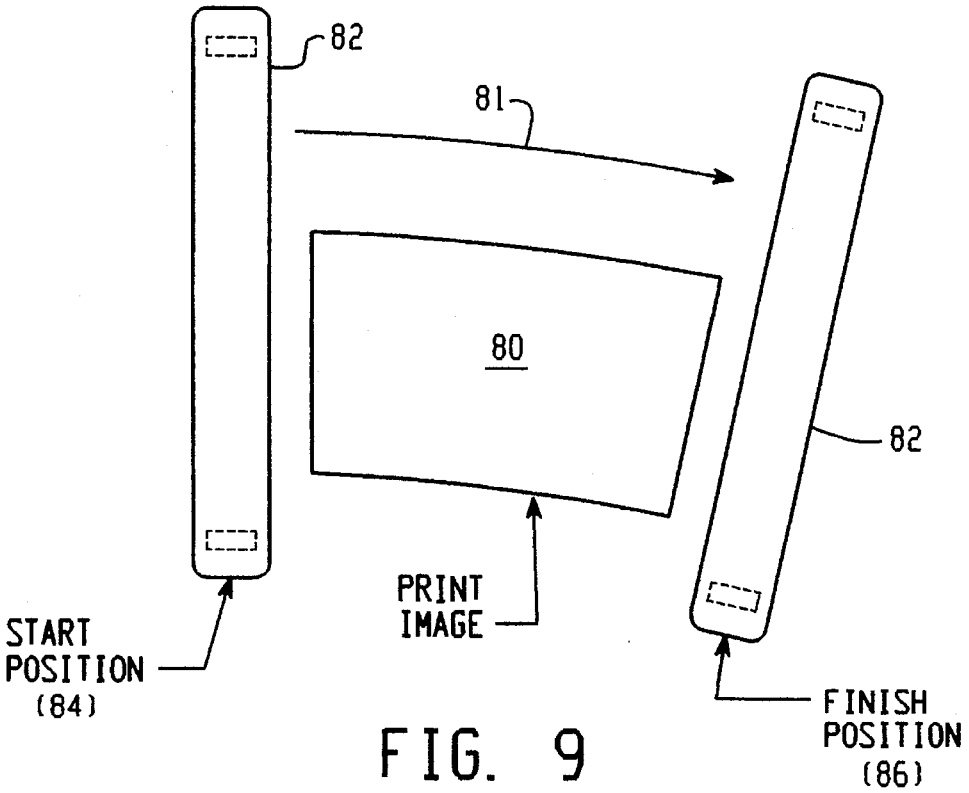
FIGS. 9 and 10 illustrate distortion compensation for printed indicia in accordance with the invention.

By way of example, FIG. 9 shows the distortion of a nominally rectangular print image 80 produced by translation of an uncompensated printer 82 over a curved path represented by the directional arrow 81 between a starting position 84 and a finishing position 86. This non-linear, in this case curved, path is typical of that produced due to the user's arm bending at the elbow.

Figure 10:
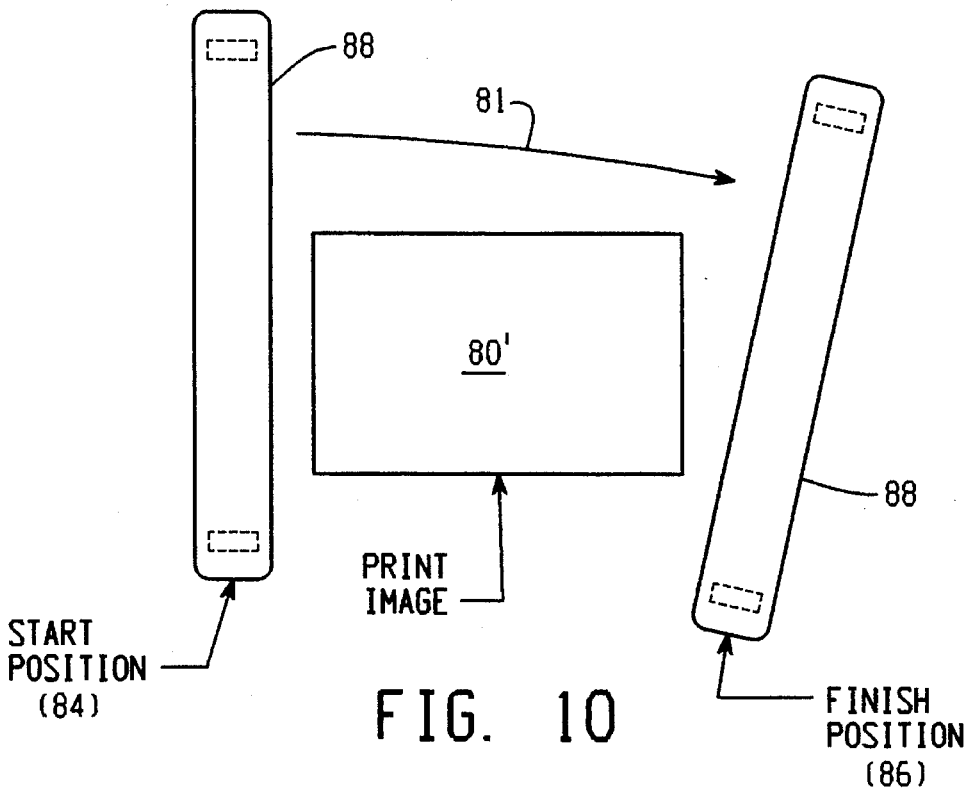

FIG. 10 shows the same rectangular print image 80' produced by a compensating printer 88 moving over the same curved path, but here the printer 88 incorporates image compensation as will be described hereinafter.

Electronic compensation for motion over a curved path is accomplished by calculating the position of the printer apparatus 10 relative to a starting point, comparing the positions of each ink jet nozzle to the coordinates of the image points to be printed, and dynamically selecting the appropriate ink jet nozzle 30 to be used to print each image point. By dynamic selection is meant that the position of each nozzle is determined during the printing sequence so that the selection of nozzles used for each line printed is not just a function of the image data stored in memory, but also a function of the nozzle positions relative to where the image dots are to be placed on the medium. This dynamic selection is preferably performed on a real time basis, although other techniques can be used such as approximating nozzle position based on averaging position changes over time periods. Compensation is preferably effected by the use of a print head 74 that includes a line of nozzles that is larger than the print area, as in the embodiment of FIG. 8. For example, referring to FIG. 9, assume that the ink jet nozzles 30 are numbered from 1 to 250, and that the upper line of the print image 80 shown is printed by nozzle #200. As the printer is moved over the curved path shown, the trajectory of nozzle #200 follows the same curved path, with the result that a curved line is printed as shown. Now, however, referring to FIG. 10, assume that print nozzle #200 is again used at the beginning of the print sweep to print the upper line of the print image. As the printer is moved over the curved path shown, it is calculated that nozzles other than #200 should be used in order to print the upper line of the image as a straight line. At the beginning of the sweep nozzle #200 is used, but as the sweep progresses the printer switches to whichever nozzle(s) have been positioned, by the movement of the printer, to correctly print the intended image. By the end of the sweep the last nozzle, nozzle #250, might be utilized.

In the example given, deviation in only one direction was considered, based upon the curving action of an operator's arm motion. Compensation can be made for deviation in only one direction, arcing towards the user as has been described, or compensation can be provided for bidirectional deviation either toward or away from the user, depending upon which set of nozzles is selected to cover an undeviated print image.

While a simple rectangle has been used for purposes of illustration, it will be appreciated by those skilled in the art that this same compensation technique may be used with any printable indicia, no matter how complex. Further, the extent to which a printable indicia can be compensated is dependent upon both the size of the image, and the number of nozzles provided. In the example given, with 250 nozzles disposed over 2.5", and printing a 2.0" high image, compensation can be made for unidirectional deviations from a straight line of up to 0.5". If the print image were only 1.5" high, unidirectional deviations of up to 1.0" could be compensated, or, similarly, if 300 nozzles were provided disposed over 3.0", a 1.0" unidirectional deviation while printing a 2.0" high image could be compensated.

In addition to compensation for translation of the printer along a curved path, the encoders 76, 78 enable compensation for forward or backward tilting or pivoting of the printer 10 with respect to the plane of the print medium. This may be accomplished by either enabling printing only when the encoder counts exceed the previous high counts, or by clearing previously printed data from the working memory, as has previously been described herein.

Figure 11:
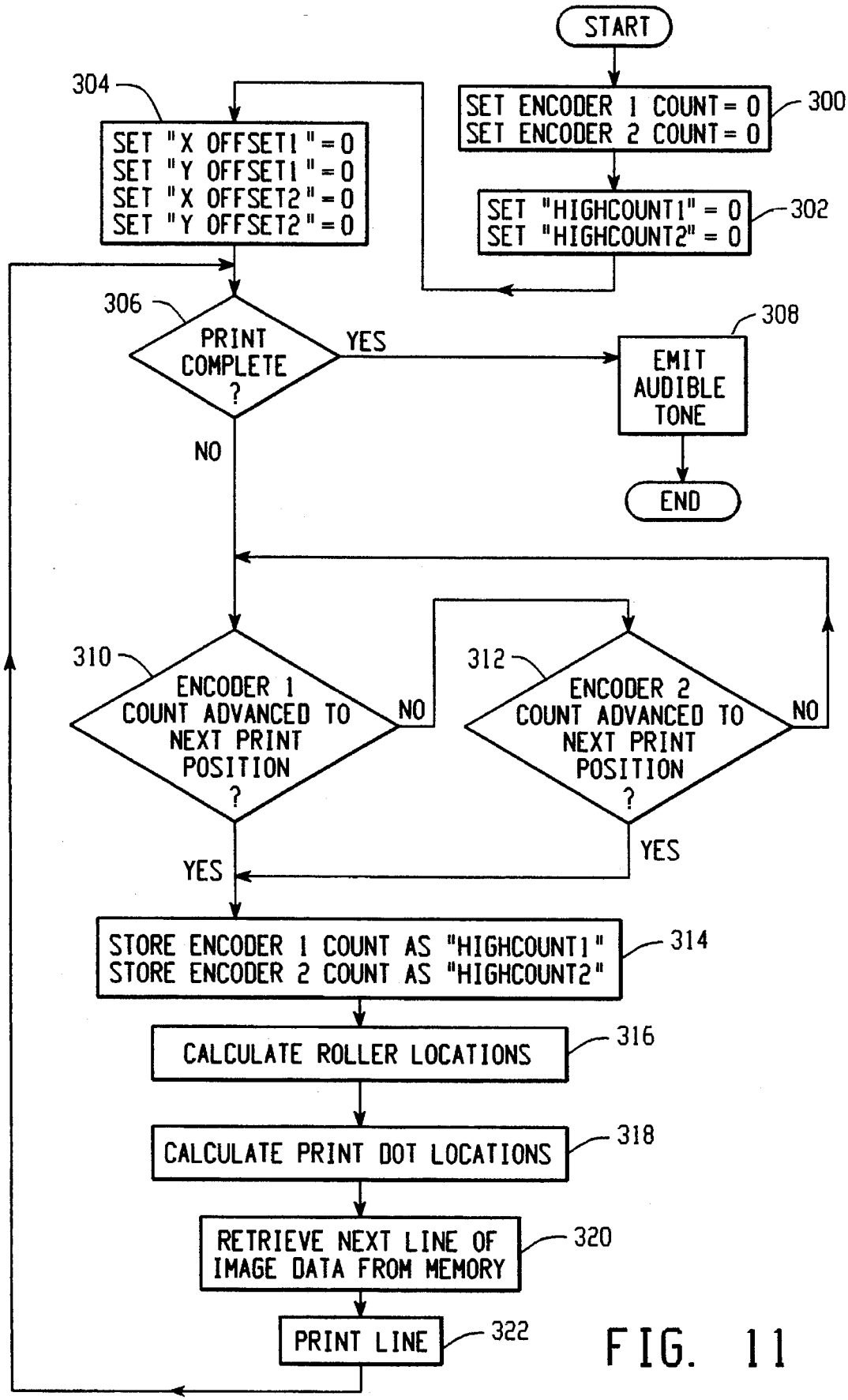
FIG. 11 is a flow chart for a control sequence of a printing operation in accordance with the invention as embodied in FIG. 8.

FIG. 11 is a flow chart for a print control program suitable for use with the invention, and in particular the embodiment of FIG. 8, including compensation for image distortion caused, for example, by non-linear movement of the apparatus 10, or tilting or pivoting of the apparatus during a printing sequence. At steps 300, 302 and 304 the encoder counts, HIGHCOUNT values and OFFSET values are all zeroed. Note that there are two values for each variable, corresponding to the use of two encoders 76, 78.

As described hereinabove with respect to FIG. 7, a print image or indicia can be described as a matrix of dots arranged in a rectangular grid, each dot having a unique X,Y address or location relative to a zero or reference position which for convenience can simply be the starting position (as manually selected by the operator) of a printing sequence. Similarly, each of the rollers 20, 22 have a unique X,Y address. For example, define the roller 20, 22 closest to the operator as roller #1, having relative position coordinates X1 and Y1, so that the roller furthest from the operator is roller #2 having relative position coordinates X2 and Y2.

The X1 and X2 relative position values are updated as the respective encoder counts increment i.e. the X1 and X2 values correspond to encoder counts though this need not be a one to one correspondence depending on the resolution of the encoders relative to the resolution of the printer.

At step 306, the program compares each of the values X1 and X2 with the maximum X value at which a dot is to be printed. If both the present X1 and present X2 values exceed the maximum X value for the printing sequence being performed, then the printing sequence is complete, an audible tone is issued at 308 and the program ends. If the sequence is incomplete or not started, the program checks at step 310 if the encoder 76 count has incremented such that the present ENCODER1 count exceeds the HIGHCOUNT1 value by at least an amount corresponding to the pitch between successive lines of dots, indicating advancing movement of the print head 74 across a printing area sufficient for further printing to take place. If yes, then the program advances to step 314. If no, the program proceeds to step 312 and in a like manner tests whether the present ENCODER2 count exceeds the HIGHCOUNT2 value by at least an amount corresponding to the pitch between successive lines of dots. If yes the program advances to step 314. If no, the program loops back to step 310 and waits for a positive result at either step 310 or 312, indicating sufficient movement for advancing to step 314 and resuming the printing operation. At step 314, the HIGHCOUNT1 and HIGHCOUNT2 values are updated with the current respective ENCODER1 and ENCODER2 count values. At step 316, the locations of the rollers 20, 22 are calculated, and at step 318 the print dot locations are calculated so that the proper nozzles 30 are dynamically selected for printing the next line of image dot data at step 320, 322.

In determining the image dot locations, offsets are determined based on the positions of the nozzles 30 on a real time basis. What is important is to be able to determine the location of each print element (e.g. each ink jet nozzle 30), relative to the starting position, with the counts from the two encoders 76, 78 as the only position indicating information. Knowing the location of each print element corresponds to knowing where positionally each print element can place its respective dot on the medium, so that the elements that are correctly positioned for the next line to be printed can be selected to produce the desired dots to form the next indicia line.

Having defined the rollers #1 and #2 hereinabove, further define the roller #1 corresponding encoder 76 count as ENC1 and the change in this count=ΔENC1. Further define the second encoder 78 count as ENC2 and the change in count=ΔENC2. Finally, define the distance between the roller 20, 22 centers as "W", where W is expressed in units of encoder counts (e.g. if W=3.0" and the encoders produce 200 counts/inch, then W=600 counts).

Ideally, the trajectory of the printer apparatus 10 would be a straight line and indeed typical prior efforts have focussed on techniques for forcing the operator to follow a straight line motion. However, the present invention is directed to providing a more convenient and in a sense forgiving apparatus, recognizing that pure linear movement is unlikely, and in particular due to the pivoting motion of the user's arm, the trajectory will (in whole or in part) instead tend to be an arc, with ENC2>ENC1. This means that at any point along the travel path, the rotational axis of the rollers 20, 22 likely will no longer be perpendicular to the intended path, but will be offset by some angle θ. While an arcing path is used herein for purposes of illustration, this same compensation technique is effective for other, more random, motion errors as well.

Angle θ can be expressed in terms of ENC1 and ENC2. A full circle of radius W counts would have a circumference of 2πW counts, so $$\theta=[ENC2-ENC1]/W \text{ radians}$$

For any θ,

X OFFSET1=ΔENC1*(cos θ)

X OFFSET2=ΔENC2*(cos θ)

Y OFFSET1=ΔENC1*(sin θ)

Y OFFSET2=ΔENC2*(sin θ)

For θ from 0 to 0.5 (the range of interest), it can reasonably be approximated that sin θ=θ, with a maximum error of just 4.11%, so that:

Y OFFSET1=ΔENC1*θ

Y OFFSET2=ΔENC2*θ but, $$\theta=[ENC2-ENC1]/W,$$

so:

$$Y\ OFFSET1=\Delta ENC1*(ENC2-ENC1)/W$$

$$Y\ OFFSET2=\Delta ENC2*(ENC2-ENC1)/W$$

Also, for θ from 0 to 0.5, a reasonable approximation is cos θ=1−(θ/5), with a maximum error of just 2.55%, so that:

X OFFSET1=ΔENC1*(1−θ/5)=ΔENC1*(1−(ENC2−ENC1)/5W) =ΔENC1−(ΔENC1*(ENC2−ENC1)/5W)

or $$X\ OFFSET1=\Delta ENC1-(Y\ OFFSET1/5)$$

similarly, $$X\ OFFSET2=\Delta ENC2-(Y\ OFFSET2/5)$$

Using only the encoder counts (and W, which is a constant), the X and Y offsets for each of the rollers are calculated whenever the printer is moved, as indicated by an increment in either encoder count. By application of these offsets to the previous X,Y coordinates for each of the rollers 20, 22, the exact relative locations of the rollers is known. Since each and every print element has a known and fixed geometric relationship to the rollers, the exact position of a dot printed by each and every print element (relative to its starting position) is calculated at step 318.

At step 320, the program retrieves from the memory 46 the print data for the image points corresponding to the individual print dot locations calculated at step 318. This print data for each image point may be simply a single data bit "0" or "1", for example, to indicate that a dot is or is not to be printed at that point, or the print data may comprise several bits to indicate, for example, a choice of dot colors.

At step 322 the line is printed. It is understood that this line of print will lie generally parallel to the axis of the rollers 20, 22 but not necessarily parallel to the Y axis, due to possible translation of the printer along a curved path. The complete print image will, nonetheless, bear its proper, undistorted relationship to the X and Y axes because of the real time compensation carried out as described hereinabove.

Figure 12:
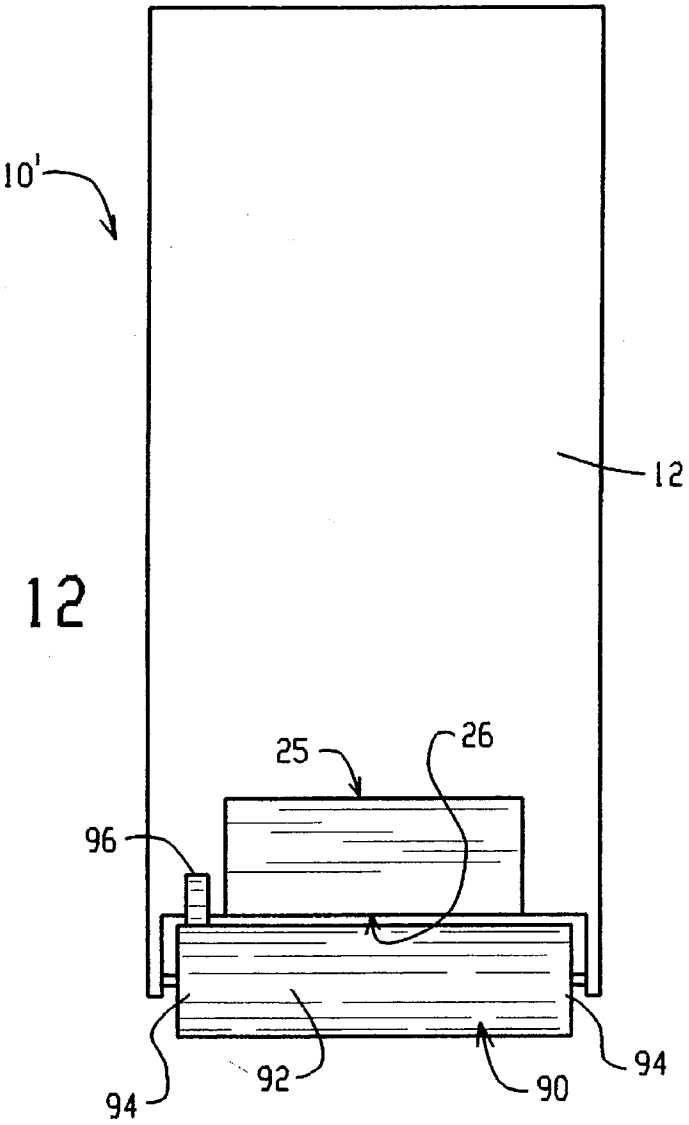

FIG. 12 is a schematic side view of a printer apparatus 10' equipped with a full line type ink print head 26. This print head 26 is equipped with a plurality of ink jet nozzles disposed to print a full line of length equal to the width of the printed area or image. If, for example, the printer is designed to print a 2" wide image with a resolution of 100 dots per inch (dpi), then the print head 1 will comprise 200 nozzles at a pitch of 0.01". The flow chart of FIG. 7, for example, is suitable for use with this embodiment.

The printer mechanism 25 is supported in use by a transfer roller 90, which has a length at least as great as the print width. The surface 92 of transfer roller 90 is made of a material which does not readily absorb ink, such as metal or non-porous rubber or plastic. In addition, the surface 92 of roller 90 should have a high coefficient of friction with the print medium, which is typically paper. In order to obtain these desired properties, transfer roller 90 may be of composite construction, where the image receiving area has optimal properties for receiving and transferring ink, while the ends of the roller 94, beyond the image area, are optimized for high friction contact with the medium. This may be achieved by the use of different materials, coatings or surface treatments for the various sections of the transfer roller 90.

An encoder 96 is driven by the transfer roller 90. The encoder 96 may be, for example, an optical encoder such as Hewlett-Packard model HEDR-8000, which provides two output channels in quadrature relationship such that both direction and magnitude of rotation are measured.

Figure 13:
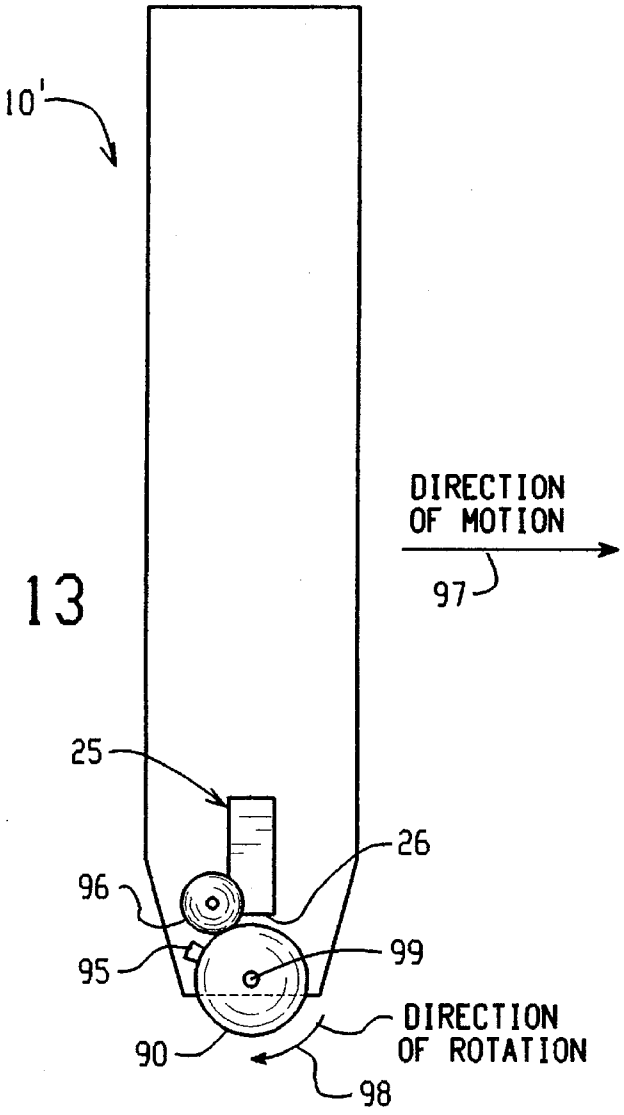
FIGS. 12 and 13 illustrate another embodiment of the invention.

FIG. 13 is a schematic end view of the same printer 10' embodiment of FIG. 12. Note that in operation, as the printer 10' is manually moved or swept across a printing area in the direction shown by the arrow 97, the transfer roller 90 rotates in the direction indicated by the arrow 98. The encoder 96 produces pulses corresponding with the motion of the printer 10' across the medium. In addition, the printer 10' is free to pivot about the rotational axis 99 of transfer roller 90.

In use, the ink jet print head 26 prints information on the surface of transfer roller 90. The rotation of the transfer roller 90 then brings this inked image on its surface into contact with the print medium, where the ink is deposited. An absorbent pad or wiper 95 removes any excess ink from the transfer roller.

The long extended area of contact between the transfer roller 90 and the print medium increases friction and makes the printer resistant to sliding motion across the medium. The force required to move the printer over the medium in a direction perpendicular to the axis of transfer roller 90 is less than that required to move the printer in any other direction, because it is only in that direction that transfer roller 90 can move only by rotation, with no sliding motion required. This helps to assure that sweeps are made in a straight line as desired.

As was first described hereinbefore, tilting or pivoting the printer 10' with respect to the plane of the medium increments or decrements the encoder 96 count in the same manner as if the printer were translated forward or backward, and thus compensation is inherently made for such pivoting motion of the printer. Further, whereas such compensation left some small residual error as applied in the embodiment of FIG. 3, that same compensation will leave no residual error in this embodiment. This is because in the earlier described embodiment herein, the print image is deposited directly on a flat surface, i.e. the print medium, while in this embodiment the print image is deposited first on a curved surface, the transfer roller 90.

As further enhancements to the utility and flexibility of the self-contained hand-held printing apparatus described hereinabove, those skilled in the art will appreciate that the use of an internal control circuit, such as the circuit 40 herein that uses a microprocessor 42 and memory circuit 46, facilitates incorporating additional user functions with the hand-held printer apparatus 10. Such additional features will now be described in terms of additional exemplary embodiments of the invention, including a calculator, personal organizer functions, voice recording and play back, voice recognition and synthesis, and postage meter functions.

The hand-held printer apparatus 10 as previously disclosed hereinabove permits implementation of a calculator, with the use of appropriate software for the microprocessor 42. Similarly, implementation of a personal organizer is available with the use of appropriate software well known to those skilled in the art. The device may, for example, function as a printing calculator. In a further example, using the personal organizer capabilities, names and addresses can be retrieved from a data base stored in the memory 46, sorted, selected and then printed on envelopes.

Figure 14A:
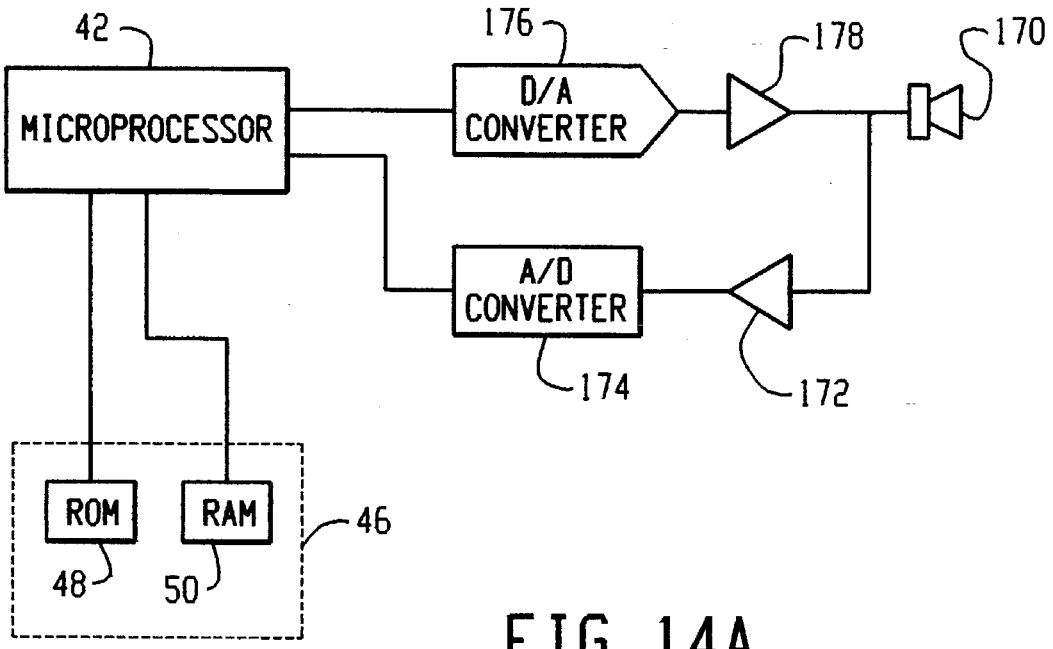
FIGS. 14A and 14B illustrate an additional feature of the invention incorporating audio input and output.

Referring to FIG. 14A, with the addition of a suitable transducer 170, amplifiers 172, 178, an analog to digital converter (A/D converter) 174, and a digital to analog converter (D/A converter) 176, the hand-held printer 10 gains the capability to serve as an audio recording and playback device. The recording time available will be limited only by the amount of memory available.

A suitable transducer 170 is a simple electromagnetic speaker or microphone, or a ceramic or crystal piezoelectric element, or any of various other devices commercially available, such as model WM-70S1 available from Panasonic. A single transducer may serve as both speaker and microphone, or two separate transducers may be used. When recording, the transducer 170 functions as a microphone, whose signal may be boosted to an appropriate level by the amplifier 172, the output of which is applied to the A/D converter 174. The A/D converter 174 converts the analog signal into digital form which can be stored in memory 46 by the microprocessor 42. At playback, the opposite process takes place, with the microprocessor 42 reading the stored digital message from memory, and applying the digital signal to the D/A converter 176. The output of the D/A converter 176 is an analog signal which is then amplified by an amplifier 178 to an appropriate level and applied to the transducer 170, which now functions as a speaker. The amplifiers 172, 178 may be selected from any number of suitable solid-state integrated circuit devices made for such purposes, and may, in fact, be integrated with their respective converters. Similarly, the A/D and D/A converters may be standard devices readily available and well-known. Some microprocessors contain such converters as an integral part, in which case separate devices are not needed.

Figure 14B:
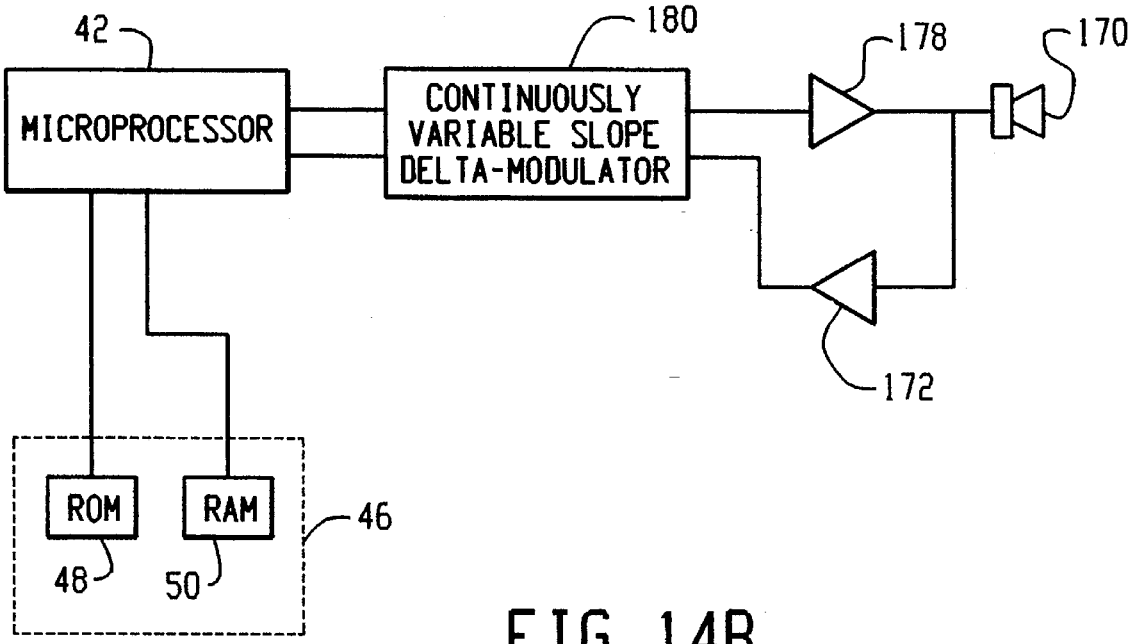

With reference to FIG. 14B, a delta-modulation technique provides an alternative and efficient method for audio signal digitization with reduced data rate and memory size requirements. An integrated circuit continuously variable slope delta-modulator 180 performs the A/D and D/A conversion functions with delta modulation, as well as automatic gain control. A suitable device for the circuit 180 is part no. HC-55564 available from Harris Corporation.

Further, with appropriate voice recognition software, the apparatus 10 can be made responsive to voice commands. For example, the spoken phrase "print confidential" would cause the device to retrieve the word CONFIDENTIAL from its memory and set itself to print that word. Similarly, voice synthesis software could be used to provide spoken communications from the printer to the user, such as, for example, "ink supply is low."

The hand-held printer 10 as described can further be provided with additional features so as to function as a postage meter.

Figure 15A:
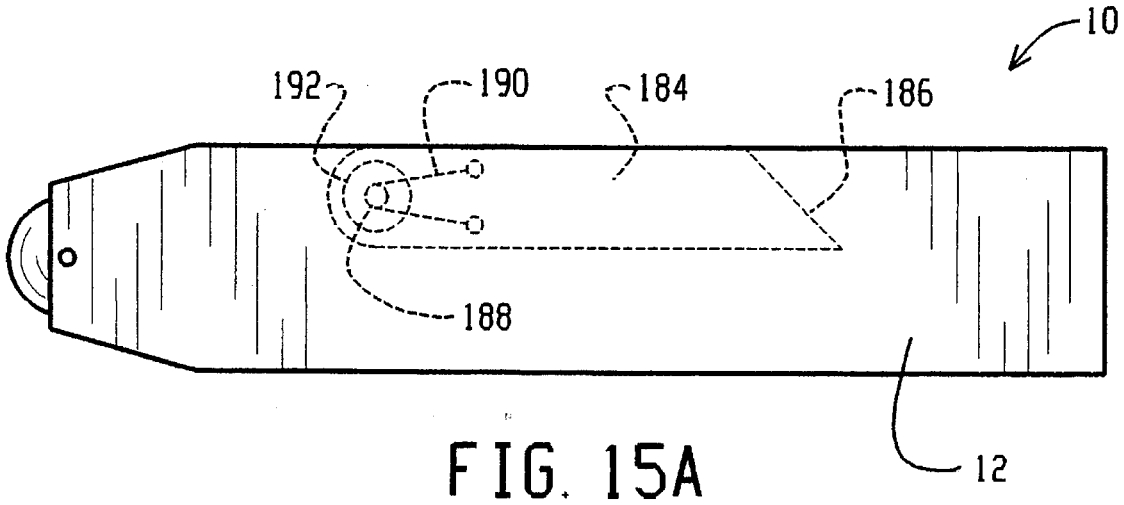
FIGS. 15A and 15B illustrate another embodiment of the invention as a postage meter and printer.
Figure 15B:
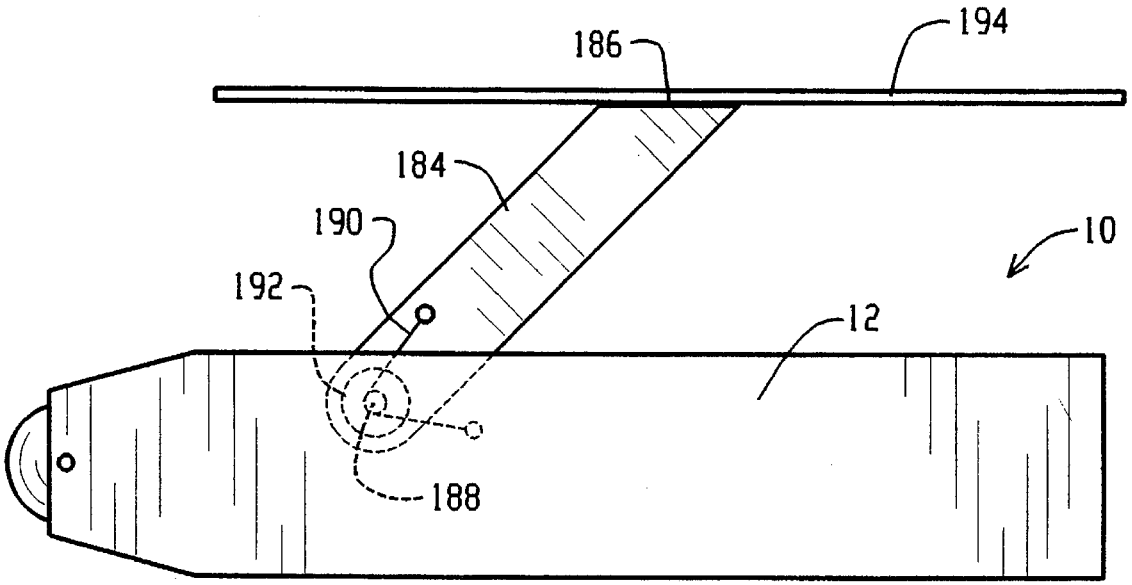

With reference to FIGS. 15A and 15B, in performing the function of a postage meter, the printer apparatus 10 prints a postage indicia in an appropriate amount, and deducts the amount of postage from a memory register which has previously been loaded with a purchased amount of postage. The postage meter imprint may include a logo and/or advertising message as may be permitted by postal regulations, with the logo or advertising message having been stored in memory 46 using the printer's interface or I/O interconnection circuits as has been described herein.

Appropriate devices and circuits can be included to load the memory register with postage in a secure manner, such that postage can be added to the register only when it has been properly purchased, as is known.

The amount of postage required to be imprinted on a particular item may be manually entered via the key pad, or, alternately, may be determined-directly by the printer device when it is equipped with a suitable weighing mechanism. A suitable weighing mechanism is a load cell as is well-known, or a calibrated spring as is well-known. Where a calibrated spring is utilized, any weight will result in a displacement of a specific amount, where the displacement can be measured by an optical encoder, a linear variable displacement transducer (LVDT), a potentiometer or Other device as are well-known.

The weighing mechanism supports an article 194 to be weighed, such that the weight can be determined. This support function may take many forms, such as, for example, a platform 184 which folds out from the front of the printer 10, as shown in FIGS. 15A and 15B. When not in use, the platform 184 is held in the stowed position as in FIG. 15A by a latch or other convenient device (not shown). In use, the platform 184 is deployed as illustrated in FIG. 15B, with the printer 10 placed on a surface as shown, and the article to be weighed placed upon the flat surface 186 provided on the platform 184. A torsion spring 190 is attached at one end to the housing 12, and at its other end to the platform 184. The torsion spring 190 reacts to the weight of the article, and the platform 184 is depressed by an amount which is a function of the weight of the article. This movement is measured or detected by an encoder 192 at the platform's pivot point 188 and input to the microprocessor 42 which then computes or otherwise determines the weight and the required postage by referring to postal rate data stored in the memory 46 or other memory device. The platform 184 is then stowed as in FIG. 15A, and the printer 10 can be actuated in the manner described in the exemplary embodiments herein, to print the postage indicia on the medium.

The present invention thus provides a fully self contained and hand-held sweeper type printer apparatus that can print a single printing sequence with electronic compensation for distortion caused by a non-linear sweep path and pivoting motion of the printer.

While the invention has been shown and described with respect to specific embodiments thereof, this is for the purpose of illustration rather than limitation, and other variations and modifications of the specific embodiments herein shown and described will be apparent to those skilled in the art within the intended spirit and scope of the invention as set forth in the appended claims.

I claim:

1. A hand-held and self contained electronic printing apparatus for printing indicia on a medium disposed outside the apparatus, comprising: a housing that can be manually positioned adjacent a surface of the medium and manually swept across a printing area on the medium during a printing sequence; a printer disposed in the housing and having a print head with a plurality of print elements for printing indicia in a selectable pattern of dots on the medium within the printing area; and electronic control means disposed in the housing for controlling the printer to print indicia on the medium during a printing sequence, said control means comprising compensation means for reducing printed indicia distortion caused by movement of said print head along a non-linear path during a printing sequence.

2. The apparatus of claim 1 further comprising user interface means for inputting print and indicia commands to a memory disposed in said housing.

3. The apparatus of claim 1 wherein print head comprises a plurality of ink jet nozzles.

4. The apparatus of claim 1 further comprising means for sensing and indicating correct position of said print head with respect to the medium to enable a print sequence.

5. The apparatus of claim 3 wherein said nozzles are disposed to project ink droplets on substantially parallel trajectories with respect to each other.

6. The apparatus of claim 1 wherein said electronic control means compensates to reduce distortion in a printed indicia caused by rotation of said print head about an axis parallel to said printing area on the medium.

7. The apparatus of claim 1 wherein the apparatus is supported on the medium during a printing sequence by a roller operably coupled to an encoder.

8. The apparatus of claim 1 wherein the apparatus is supported on the medium during a printing sequence by a plurality of rotatably joined rollers.

9. The apparatus of claim 8 wherein said plurality of said rollers are operably coupled to an encoder.

10. The apparatus of claim 1 wherein the apparatus is supported on the medium during a printing sequence by a plurality of rotatably independent rollers.

11. The apparatus of claim 10 wherein each of said plurality of said rollers is operably coupled to a respective encoder.

12. The apparatus of claim 1 further comprising an encoder that produces an output used to determine print head position during a printing sequence.

13. The apparatus of claim 12 wherein said control means determines position where each dot can be printed by each print element during a printing sequence as a function of said encoder output.

14. The apparatus of claim 13 wherein said control means dynamically selects a number of said print elements for printing an indicia during a printing sequence based on said determined dot positions and the indicia to be printed.

15. The apparatus of claim 1 wherein said control means comprises a memory that electronically stores a plurality of selectable indicia that can be selected for printing during a printing sequence.

16. The apparatus of claim 1 further comprising input means disposed in the housing for an operator to select a number of said stored indicia for printing.

17. The apparatus of claim 16 wherein said input means comprises a keypad and visual display devices that are used by the operator to create an indicia pattern to be printed.

18. The apparatus of claim 17 wherein said memory stores a control program and instructions such that the apparatus is manually operational in a stand alone configuration independent of electronic input controls from an external source.

19. The apparatus of claim 1 further comprising communications means disposed in the housing for transmitting instructions, commands and data between said apparatus and an external control device.

20. The apparatus of claim 19 wherein the external device comprises a personal computer.

21. The apparatus of claim 19 wherein said communication means comprises a wireless link between said apparatus and the external device.

22. The apparatus of claim 19 wherein said communication means includes a device selected from the group consisting of: an RF transceiver, acoustic transceiver, optical transceiver, modem, serial port and parallel port.

23. The apparatus of claim 1 wherein said printer comprises a print head having a number of print elements disposed to print on an intermediate transfer medium.

24. The apparatus of claim 1 wherein said control means accumulates a total count of dots printed by said printer and produces an output indicating low ink supply based on said accumulated total count.

25. The apparatus of claim 1 wherein said control means accepts a plug-in module for transferring information between the apparatus and an external source.

26. The apparatus of claim 1 further comprising a sensor that enables a print sequence when the apparatus is correctly positioned with respect to the medium.

27. The apparatus of claim 1 wherein said printer includes means for printing indicia in a number of colors.

28. The apparatus of claim 1 wherein said control means dynamically compensates to reduce distortion in a printed indicia caused by pivoting motion of the apparatus during a printing sequence.

29. The apparatus of claim 28 wherein said control means further compensates for distortion caused by non-linear movement of the print head across the printing area.

30. The apparatus of claim 1 where said compensation means dynamically selects which of said plurality of print elements to use for printing during a printing sequence based on the next line to be printed and position of each dot to be printed, wherein dot position is determined based on an encoder.

31. The apparatus of claim 30 wherein said print head comprises a line of said print elements, with said print elements extending over a length that is greater than the width of said printing area.

32. The apparatus of claim 1 further comprising a manually actuated enable switch that enables operation of the printer and inhibits keypad control during a printing sequence.

33. The apparatus of claim 1 further comprising an audible signal source for indicating completion of a printing sequence.

34. The apparatus of claim 1 further comprising a weight device stowed in said housing for weighing an article, wherein said control means computes a postage value based on said measured weight for printing on said medium.

35. The apparatus of claim 34 wherein said weight device includes a platform pivotally retractable from said housing that supports an article to be weighed.

36. The apparatus of claim 35 further comprising displacement means for determining weight of an article as a function of displacement of said platform when the article is placed thereon.

37. The apparatus of claim 1 further comprising means for audio input, audio storage and audio output.

38. A hand-held and self contained electronic printing apparatus for printing indicia on a medium disposed outside the apparatus, comprising: a housing that can be manually positioned adjacent a surface of the medium and manually swept across a printing area on the medium during a printing sequence; a printer disposed in the housing and having a print head with a plurality of print elements for printing indicia in a selectable pattern of dots on the medium within a printing area; and electronic control means disposed in the housing for controlling the printer to print indicia on the medium during a printing sequence, said control means comprising compensation means for reducing printed indicia distortion caused by a pivoting movement of the print head about an axis during a printing sequence.

39. The apparatus of claim 38 wherein said compensation means reduces printed indicia distortion caused by rotational movement of the print head about an axis perpendicular to the printing area during a printing sequence.

40. The apparatus of claim 38 wherein said compensation means reduces printed indicia distortion caused by a pivoting movement of the print head about an axis parallel to the printing area during a printing sequence.

41. Method for printing indicia on a medium disposed outside the printing apparatus, using a hand-held electronic printing apparatus self-contained within a housing, comprising the steps of:

positioning the housing adjacent a surface of the medium and manually sweeping the apparatus across a printing area on the medium during a printing sequence;

printing indicia as a selectable pattern of dots on the medium within the printing area, using a print head having a plurality of printing elements, as the apparatus is swept across the printing area; and compensating for printed indicia distortion caused by a pivoting movement of the print head about an axis during a printing sequence.

42. The method of claim 41 comprising the step of compensating for printed image distortion caused by rotational movement of the print head about an axis perpendicular to the printing area during a printing sequence.

43. The method of claim 41 comprising the step of compensating for printed image distortion caused by a pivoting movement of the print head about an axis parallel to the printing area during a printing sequence.

* * * * *